United States Patent [19]

Duwaer et al.

[11] Patent Number: 4,775,817

[45] Date of Patent: Oct. 4, 1988

[54] FACEPLATE COOLING SYSTEM FOR DISPLAY TUBE

[75] Inventors: Arne L. Duwaer, Ossining, N.Y.; Bernardus J. Brugman, Eindhoven, Netherlands

[73] Assignee: U.S. Philips Corporation, New York, N.Y.

[21] Appl. No.: 82,026

[22] Filed: Aug. 5, 1987

[30] Foreign Application Priority Data

Aug. 6, 1986 [NL] Netherlands ..... 8602007

[51] Int. Cl.[4] ..... H01J 29/86; H01J 19/74

[52] U.S. Cl. ..... 313/12; 313/36; 313/22; 313/477 R; 417/407

[58] Field of Search ..... 313/12, 36, 35, 477 R, 313/22; 417/406, 407; 62/99; 361/385

[56] References Cited

U.S. PATENT DOCUMENTS 3,252,298 5/1966 Andrews ..... 417/407 X

FOREIGN PATENT DOCUMENTS 3400067 7/1984 Fed. Rep. of Germany ..... 313/22

*Primary Examiner*—Palmer C. DeMeo

*Attorney, Agent, or Firm*—John C. Fox

[57] ABSTRACT

The invention relates to a display tube which is cooled by a flow of a translucent cooling liquid through a sealed space adjacent the display window, stimulated by a fluid-driven pump having two chambers, a drive chamber driven by a remotely located active electric motor driven pump, and a pump chamber responsive to the drive chamber and connected to the sealed space. Fields generated by the motor of the electric pump do not interfere with the operation of the display tube.

7 Claims, 2 Drawing Sheets

FACEPLATE COOLING SYSTEM FOR DISPLAY TUBE

BACKGROUND OF THE INVENTION

The invention relates to a display tube comprising an envelope including a display window having on its inside surface a display screen; a transparent, substantially parallel, second window provided in parallel spaced relationship to the outside surface of the display window; and a pump, the space between the display window and the second window being destined for a flow of a translucent cooling liquid stimulated by the pump.

The invention also relates to a colour television projection device comprising such a display tube.

A display tube as mentioned hereinbefore is known from EP-A-No. 162972. The display screen of such a display tube usually comprises a phosphor layer on which a frame is written by means of an electron beam. As a result of the electron bombardment the temperature of the display screen rises so that the luminous efficiency of the display screen decreases. This effect is termed thermal quenching. This is the case in particular in display tubes for projection television, in which, in order to obtain the required high brightnesses, the display screens are scanned by electron beams with large beam currents. In order to check the decrease of the luminous efficiency as described in EP-A-No. 162972, the display window and the display screen disposed thereon are cooled by causing the cooling liquid to flow through the space between the display window and the second window by means of a pump driven by an electric motor. Since the motor is present at a very short distance from the display tube, the operating motor may adversely influence the path of the electron beams in the display tube due to its electromagnetic properties, which may for example give rise to frame errors.

It is an object of the invention to provide a display tube which is cooled by pumped flow of a cooling liquid through the space between the display window and the second window and in which no detrimental influences are exerted on the operation of the display tube.

SUMMARY OF THE INVENTION

A display tube of the type mentioned in the opening paragraph is characterized according to the invention in that the pump is a fluid-driven pump which can be driven by a driving system comprising a remotely located active pump. The use of a fluid driven pump introduces no electromagnetic interference fields so that upon writing a frame on the display screen the frame is not distorted.

A preferred form of a display tube according to the invention is characterized in that the driving system for driving the fluid-driven pump is an additional, secondary cooling system. By using the driving system as secondary cooling system, the overall cooling of the display tube is significantly enhanced.

A further preferred form of a display tube in accordance with the invention is characterized in that the fluid-driven pump is manufactured from a thermally conductive material so that the thermal energy generated by the tube can readily be dissipated from the primary cooling system to the secondary cooling system, which provides a good cooling for the display tube.

Still a further preferred form of a display tube in accordance with the invention is characterized in that the fluid-driven pump comprises: a housing divided into two chambers by an apertured partition, two impellers connected together via a shaft through the aperture, one of the said impellers being present in the driving system and the other one in the primary cooling system. The stimulation of the flow of the cooling liquid is achieved by driving the first impeller via a flow in the driving system produced by a remotely located active pump. Said second impeller in turn stimulates the flow of the primary cooling liquid in the cooling system.

A display tube as described hereinbefore may very suitably be used in a colour television projection device.

A colour television projection device according to the invention is characterized in that it comprises three such display tubes in which the drive chambers of the fluid-driven pumps of the display tubes are connected in series with an active pump and a heat exchanger forming a collective driving system. By using a collective driving system only one active pump and one heat exchanger are necessary. The active pump can be accommodated at some distance from the display tubes so that no detrimental electromagnetic influences on the display tubes occur. The heat exchanger may also be placed at some distance from the display tubes so that no detrimental electromagnetic influences on the display tubes occur. The heat exchanger may also be placed at some distance from the display tubes so that, for example, forced air cooling may be used.

BRIEF DESCRIPTION OF THE DRAWINGS

The invention will be described in greater detail, by way of preferred embodiment, with reference to the drawing, in which.

DESCRIPTION OF THE PREFERRED EMBODIMENTS

Figure 1:
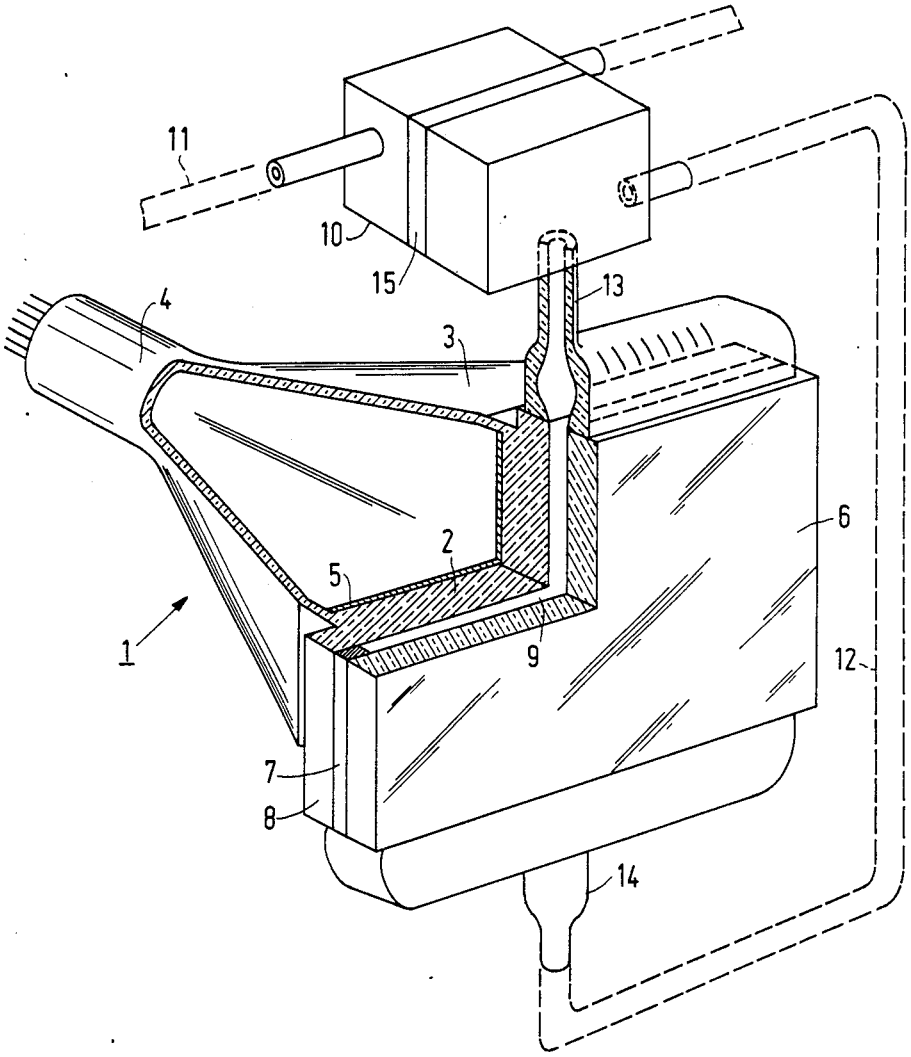
FIG. 1 is a perspective view, partly broken away, of a display tube according to the invention.
Figure 2:
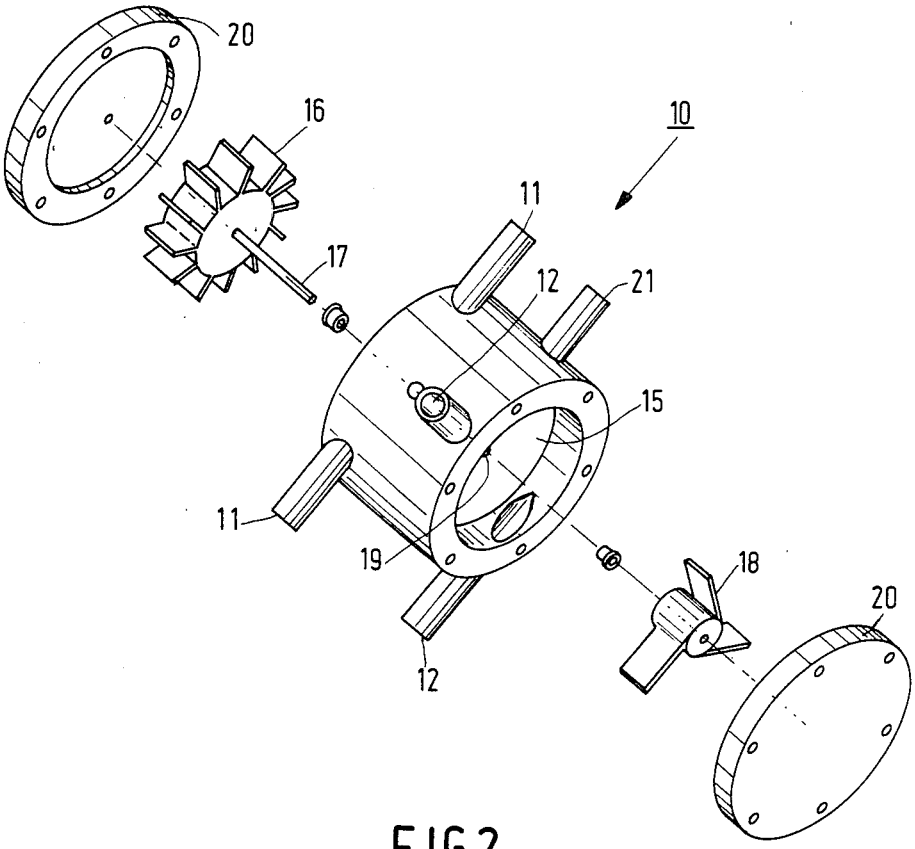
FIG. 2 is an exploded view of a fluid-driven pump suitable for use in the invention and FIG. 3 shows diagrammatically a colour television projection device.

FIG. 1 is a perspective view, partly broken away, of a display tube 1 according to the invention. The glass envelope comprises a substantially rectangular display window 2, a cone 3 and a neck 4. Means (not shown) for generating at least one electron beam are present in the neck 4. The beam is deflected during operation of the tube and which describes a frame on the display screen 5 on the inside of the display window 2. The display screen 5 consists of a phosphor or of a pattern of different phosphor regions. A second window 6 is provided substantially parallel to the display window 2 and spaced from the window 2 by means of a seal 7 which engages a collar 8 provided around the display window 2. Between the display window 2 and the second window 6 a space 9 is present which is destined for the flow of a translucent liquid. A fluid-driven pump, shown diagrammatically by element 10, is driven by a driving system, indicated in part at 11, insure a stimulated flow of the cooling liquid through a cooling system 12 which comprises a part of the fluid-driven pump 10, an inlet pipe 13, the space 9, and the outlet pipe 14. The driving of the fluid-driven pump 10 via the driving system 11 may be done inter alia by means of compressed air or by means of a liquid. Although the inlet and outlet pipes 13 and 14 are shown in the drawing as being substantially opposite to each other, the invention is not restricted thereto. The driving system 11 is separated from the cooling system 12 by means of a partition 15. The driving of the fluid-driven pump 10 by the driving system 11 for stimulating the flow of the cooling liquid through the system 12 is accomplished as shown in FIG. 2. The flow liquid through the driving system 11 rotates an impeller 16, which rotation is transmitted through partition 15 to a second impeller 18 by means of a shaft 17. The movement of said second impeller 18 stimulates the flow of the cooling liquid in the cooling system 12. Partition 15 has an aperture 19 through which the shaft 17 passes in a fluid-tight manner. The pump 10 is sealed by two lids 20. The ratio of the number of blades of the impellers is not restricted to the ratio given in FIG. 2. The number of blades per impeller may, for example, be equal. For the purpose of deaeration, a vent pipe 21 is provided in the house of pump 10.

In the case in which the fluid-driven pump 10 is driven by means of a liquid, in particular a cooling liquid, which flows through the driving system 11, it is possible to use the driving system 11 as an additional, secondary cooling system for the display tube. By manufacturing the fluid-driven pump 10 from a thermally conductive material, for example, aluminium, a good heat exchange is obtained between the primary cooling system and the secondary cooling system.

Figure 3:
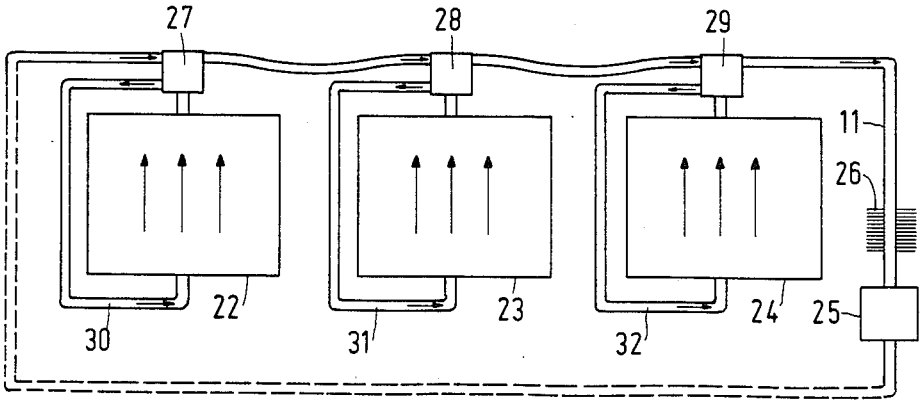

FIG. 3 shows diagrammatically a colour television projection device. It comprises three display tubes 22, 23, 24. An active, electric motor driven, pump 25 circulates a cooling liquid through the secondary cooling system 11, the cooling liquid being cooled in a heat exchanger 26. The heat exchanger 26 may be cooled, for example, by forced air cooling. The flow of the cooling liquid is indicated by the arrows in FIG. 3. As a result of the flow of the cooling liquid in the secondary cooling system 11, the fluid-driven pumps 27, 28 and 29 of the display tubes 22, 23 and 24 are driven. As a result of the stimulated flow of the cooling liquid through the spaces of the display tubes 22, 23, as well as 24 and the heat exchange between the primary cooling system 30, 31 and 32 and the secondary cooling system 11, the cooling of the display tubes is quite satisfactory. By arranging the active pump 25 at some distance from the display tubes 22, 23 and 24, the display tubes experience no detrimental disturbances as a result of electromagnetic fields generated by the active pump 25.

For replacing one of the display tubes, the fluid-driven pump need be closed only on the side of the secondary cooling system. Thus, no air bubbles can penetrate into the primary cooling system of the replacement display tube during the connections.

The invention is not restricted to the embodiments described. Other embodiments and variations will become apparent to those skilled in the art without departing from the scope of this invention.

What is claimed is:

1. A display tube comprising: an envelope including a display window having on its inside surface a display screen; a transparent second window in parallel spaced relationship to the outside surface of the display window; means for sealing the space, and inlet and outlet means communicating with the sealed space between the display window and the second window for accommodating a flow of a translucent cooling liquid through the space; and a pump;

characterized in that the pump is a fluid-driven pump comprising: a housing, a partition separating the housing into first and second chambers; drive means located in the first chamber; pump means located in the second chamber and responsive to the drive means; and inlet and outlet means associated with each chamber, the inlet and outlet means for the second chamber connected to the inlet and outlet means for the sealed space, and the inlet and outlet means for first chamber for connection to a remotely located active pump, whereby upon circulation of a drive liquid through the first chamber, cooling liquid is circulated through the second chamber and the sealed space.

2. A display tube as claimed in claim 1, characterized in that the fluid-driven pump is composed of at least one thermally conductive material.

3. A display tube as claimed in claim 1, characterized in that the drive means and pump means comprise first and second impellers, and in that the impellers are connected together via a shaft passing through an aperture in the partition.

4. A color television projection device comprising at least one display tube as claimed in claim 1.

5. A color television projection device as claimed in claim 4, characterized in that it comprises three display tubes, in which inlet and outlet means of the first drive chambers of the fluid-driven pumps of the display tubes are connected in series to a remotely located active pump, to form a collective driving system.

6. A color television projection device as claimed in claim 5, characterized in that the fluid-driven pump is composed of at least one thermally conductive material.

7. A color television projection device as claimed in claim 5, characterized in that the collective driving system includes a heat exchanger.

* * * * *